US006059609A

United States Patent [19]

Nieto

[11] Patent Number: 6,059,609

[45] Date of Patent: May 9, 2000

[54] MOVEABLE FUSE-HOLDER

[75] Inventor: Gonzalo Brotons Nieto, Tarragona, Spain

[73] Assignee: Lear Automotive Dearborn, Inc., Southfield, Mich.

[21] Appl. No.: 09/155,665

[22] PCT Filed: Jan. 29, 1998

[86] PCT No.: PCT/US98/01733

§ 371 Date: Oct. 1, 1998

§ 102(e) Date: Oct. 1, 1998

[87] PCT Pub. No.: WO98/34262

PCT Pub. Date: Aug. 6, 1998

[30] Foreign Application Priority Data

Feb. 4, 1997 [ES] Spain ..... 9700274

[51] Int. Cl.[7] ..... H01R 13/68

[52] U.S. Cl. ..... 439/621

[58] Field of Search ..... 439/622, 621, 439/353, 354, 357, 358; 337/194, 196, 198

[56] References Cited

U.S. PATENT DOCUMENTS 5,247,250 9/1993 Rios ..... 324/158 F 5,378,168 1/1995 Sumida ..... 439/358

5,488,345 1/1996 Seki et al. ..... 337/136

FOREIGN PATENT DOCUMENTS 2735280 6/1995 France ..... H01H 85/20

*Primary Examiner*—Steven L. Stephan

*Assistant Examiner*—Brian S. Webb

*Attorney, Agent, or Firm*—MacMillan, Sobanski & Todd, LLC

[57] ABSTRACT

A moveable holder which facilitates holding one or more electrical circuit components in a selected position relative to a receptacle for containing circuit terminals. The holder includes arm portions with detents that abut against an aperture of the associated receptacle. The detents are positioned on the arm portions to permit the holder to be placed in a position where the electrical component is connected with the receptacle or disconnected from the receptacle. A depressible portion on the arm portion is manually depressed to move the detents inwardly to permit the holder to be repositioned.

9 Claims, 1 Drawing Sheet

MOVEABLE FUSE-HOLDER

BACKGROUND OF THE INVENTION

This invention generally relates to a moveable fuse holder having manufacturing, shaping and design characteristics that are specifically designed to maximize safety and efficiency.

A variety of moveable fuse-holders specially designed for the automotive field exist in the market whose configuration and characteristics are a function of the specific application to which they are intended. Therefore, most available fuse holders have a limited utility. Moreover, there is no fuse-holder adequate to be applied to an instantaneous inflating device such as an airbag.

In an airbag or similar device it is of paramount importance that the operative safety of all parts is equally reliable, since it functions in the cases of a front collision with an instantaneous inflation produced in milliseconds.

The function of the fuse-holder of this invention is that of being integrated into the airbag or other device. This provides a significant advantage because it is mandatory that the assembly of the fuse-holder in the pre-assembly operations of the superior assembly (i.e., the airbag) does not set off or deploy the device. Further, the quality, measures, tolerances and other technical characteristics of the inventive fuse-holder, are of the higher quality and accuracy compared to prior designs, since the preferred destination is into a device of safety enhancement for the user in the event of a car crash.

SUMMARY OF THE INVENTION

The moveable fuse-holder preferably has a prismatic body of a generally U-shaped configuration, which includes turrets joined or related by a bridge part. The upper portion preferably has a cover that allows the entering of the corresponding fuses in the open position and when in the closed position holds them firmly. The cover preferably allows the characteristics and situation of the fuses inside the fuse-holder to be visible when the cover is closed.

The fuse-holder turrets preferably are provided with a series of elements allowing the introduction of the fuse-holder down to the end of the housing, insuring a proper connection of the fuses when the elements are in a first position. In a second position, by pressing the suitable elements and releasing the appropriate catches, it is possible to extract the fuse holder up to the initial pre-assembly position, insuring the disconnection of the fuses introduced in the fuse-holder.

Other details and characteristics of the present invention will become apparent through reading the description given below, in which reference is made to the figures attached to this description where the above details are depicted in a rather schematic way. These details are given as an example, referring to a case of a possible practical embodiment, but the invention is not limited to those details. Therefore, the detailed description must be considered from an illustrative point of view, and with no limitations whatsoever.

DETAILED DESCRIPTION OF THE PREFERRED EMBODIMENT

Figure 1:
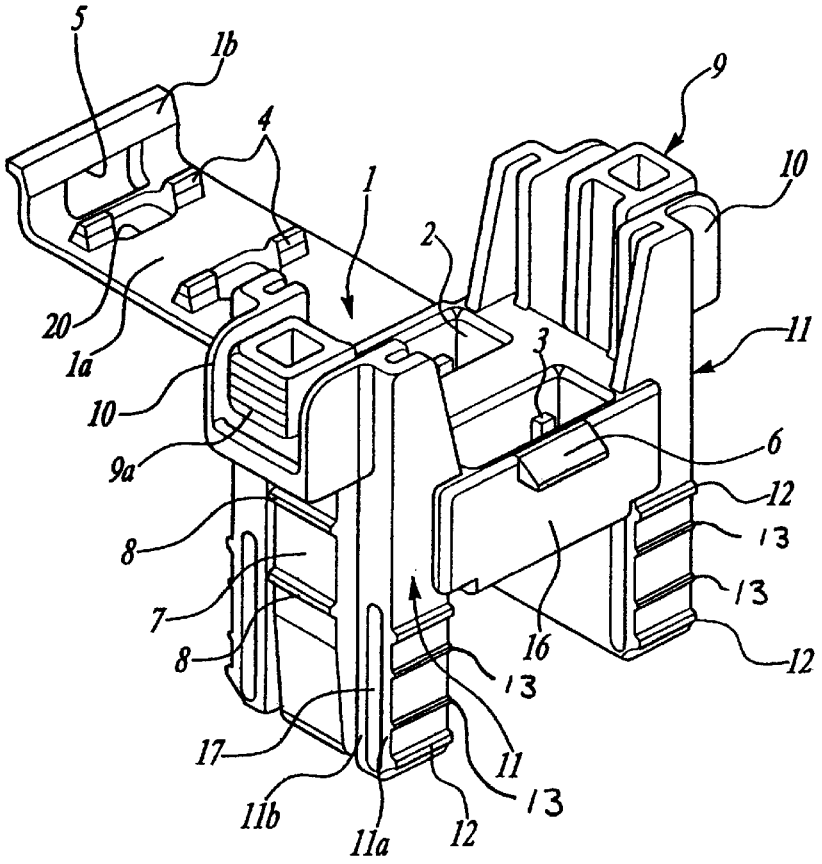
FIG. 1 is a perspective view of the fuse holder with the moveable cover in an open position and before the fuses had been introduced.
Figure 2:
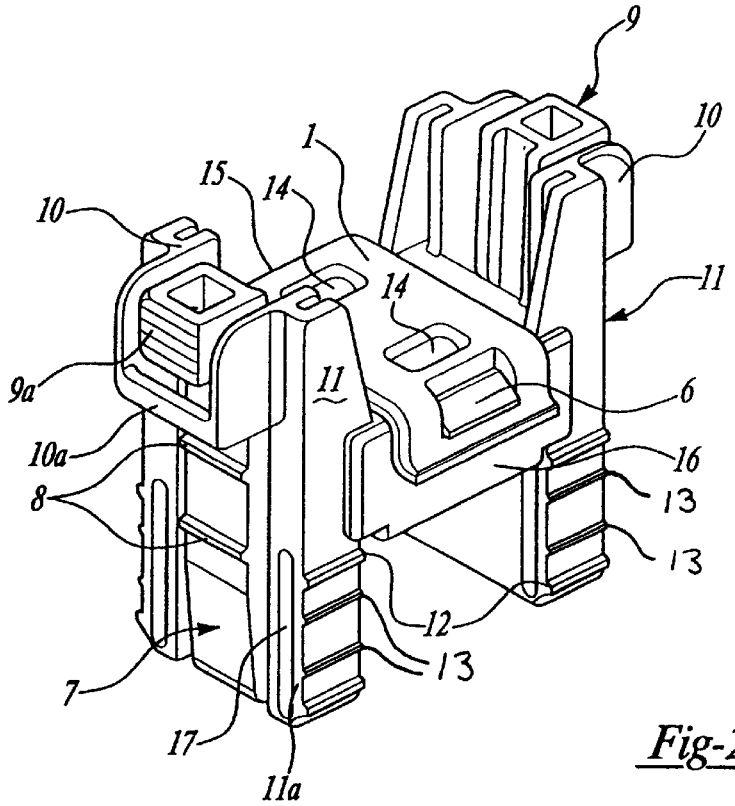
FIG. 2 is a perspective view similar to FIG. 1, but after the fuses had been introduced into the housings and the cover has been closed over them.

In the preferred embodiment and as can be seen in FIGS. 1 and 2, the inventive fuse holder is formed with turrets 11 that are designed for positioning tasks and are connected by a bridge 16. The upper part of the bridge includes the catch 6, whose function will be explained below.

A moveable cover 1 is supported on the rear side of the bridge 16 opposite from the catch 6. The moveable cover 1 is formed with a flat zone 1*a* out of the free edge of which, opposite to the hinge zone, has a lapel or latch 1*b* including a notch 5 allowing the cover 1, when in the closed position (see FIG. 2), to be held in the closed position by the catch 6. Out of the reverse of the flat zone la of the moveable cover 1 emerge stops 4 which function to immobilize the fuses when they are placed inside the housings 2.

The turrets 11 preferably are formed with two legs, each joined in its lower part with small walls 11*a* and 11*b* leaving between them a void area 17. An outer side of the small wall 11*a* includes ridges 12 and 13. Ridges 12 and 13 abut against an aperture of an associated receptacle (not shown). The first ridges 12 prevent the fuse holder from being undesirably dismantled, while the second ridges 13 serve as stoppers of the guiding and positioning turrets.

Between every two legs of the turrets 11 there preferably is a stopper arm 7 that includes two ridges 8, which function as moveable stoppers.

Out of the upper part of the turrets 11 emerge balconies 10*a*, which cross section is U-shaped, that protect the actuator 9. The balconies 10*a* form part of a pair of spaced apart protective shoulders 10 and have a generally prismatic configuration. One of the front faces of the actuator 9 has a series of ridges 9*a* that allow the user to manipulate the fuse holder into position without slipping from the fingers.

The operation procedure of assembly of the fuse holder consists, as can be seen in FIG. 2, in placing fuses 14 into the cavities 2 in order to, and with the help of the lower stops 3 and upper stops 4, proceed to the immobilization and perfect positioning of the fuses 14 inside the cavities 2 and therefore be able to close the cover 1 and, with the help of the stops 4 positioned on the reverse or underside 1*a* of the cover 1, keeping them firmly immobilized inside 2.

The moveable cover 1 has two positions. The first one, seen in FIG. 1, is considered open allowing the change of the fuses 14 placed into the cavities 2. The second closed position of the cover (see FIG. 2) insures the position of the fuses 14 inside the holder. When the cover 1 is closed, the fuses are visible through slots 20 in the cover.

The fuse housing cavities 2 has been designed in such a way that the stops 3 and 4 guide and protect the fuses once they are introduced inside the cavities 2. The lower stops 3 support the fuses avoiding any slipping downwards, while the stops 4 avoid any slipping towards the outside.

The catch 6 snappingly receives the notch 5 to allow the fixation of the moveable-cover 1 in the closed position.

The stopper arm 7 facilitates maintaining the fuse holder assembly in two positions; pre-assembled and assembled. To move the assembly from the first position into the latter position, by pressing the actuator 9 the moveable stoppers 8 become free and allow the introduction of the part down to the end of its housing in the appropriate location within the device (i.e., an airbag assembly), insuring proper fuse connection. When the actuator 9 is pressed, the stopper arm 7 moves inwardly thereby simultaneously moving the stoppers 8 inwardly free of interference with the aperture of the associated receptacle. Similarly, the assembly is moveable into the second position, by pressing the actuator 9 such that the moveable stoppers 8 become free and can be pulled out or up to the initial position of the assembly, insuring the disconnection of the fuses.

The moveable stoppers 8 produce the interference between the part and its lodging in the device, marking the two positions of the part: pre-assembled and assembled.

The actuator 9 has the object of letting the moveable-stoppers 8 free and allowing the fuse holder to be moved into the two available positions. The actuators 9 are protected by the balconies 10*a* to avoid accidental or fortuitous blows to the actuators 9.

The positioning guide turrets 11 have generally the function of guiding the full part inside its housing in the fuse holder box. Meanwhile the stoppers 12 function to prevent the dismantling or complete remove of the assembly since, once the part is partly entered in its housing in the box, the stoppers flex allowing then the introduction of the part in the guide and, once free when it arrives to the end of the hole, they recover their natural state and impede the extraction of the part outside the fuse holder box.

The stoppers 8 guide and position the turrets 11. The stoppers 8 also are for adjustment between the part and its housing in the fuse holder box. Its object is that of flexing and marking the two positions of the part from assembled to pre-assembled and vice versa.

The sight of the fuses 14 allows seeing the amperage of the fuses, while a hinge portion 15 of the cover 1 allows the movement of the moveable cover 1 as described above. The general object of the fuse holder is that of designing a part where the two fuses are housed in such a way that the electrical connection is established through a manual action, as well as its disconnection also by manual action. This part is specially indicated for the safety functions such as those of the airbag, ABS devices and the like.

The part in itself is designed with the object of insuring the contact of the fuses lodged inside the box, being necessary the part manipulation in its different positions: pre-assembly, assembly and extraction. It is necessary to handle the stopper arm 7 for being able to free the moveable stoppers 8, as well for insuring the box connection as well as its disconnection. The stoppers 8 are released upon the actuator 9 being moved inwardly to thereby simultaneously move the stoppers 8 inwardly to become free of interference with the associated receptacle.

The rugged and strong design is thought for avoiding undesired fortuitous blows, insuring always the correct position of the part, given the restrictive safety conditions demanded for becoming part of the above named devices such as airbag, ABS and the like.

The preceding description is exemplary rather than limiting in nature. Variations and modifications are possible that do no depart from the spirit and purview of this invention. The scope of legal protection is limited only by the following claims.

What is claimed is:

1. In a disconnection mechanism for holding an electrical circuit component including a connection terminal for containing an electrical circuit component and a receptacle for containing circuit terminals for electrical connection with the electrical circuit component of the connection terminal, the receptacle including an aperture for receiving the connection terminal, wherein the connection terminal comprises:

a main body, said body including two spaced apart substantially parallel turret members, a bridge member having a hollow interior for containing an electrical circuit component for connection with the circuit terminals of the receptacle, the bridge member extending between the turret members and connected thereto, each of the turret members having normally outwardly urged arm portions with projecting detents adapted to abut against the aperture of an associated receptacle and militate against the removal of said body from the receptacle, and a manually depressible portion of the arm portions for moving the detents inwardly to permit the removal of said body from an associated receptacle.

2. In a disconnection mechanism as defined in claim 1, wherein the interior of the bridge member includes a stop member.

3. In a disconnection mechanism as defined in claim 2, wherein the interior of the bridge member contains two electrical circuit components.

4. In a disconnection mechanism as defined in claim 3, wherein the bridge member includes a cover having two slots aligned with the electrical circuit components.

5. In a disconnection mechanism as defined in claim 4, wherein the bridge member extending between the turrets includes a catch extending from the bridge member, wherein the cover includes a notch that snappingly engages the catch.

6. In a disconnection mechanism as defined in claim 1, wherein the turrets of said main body each include a ridge near one end of the turrets, such that the disconnection mechanism is protected from being inadvertently completely removed from the receptacle.

7. In a disconnection mechanism as defined in claim 1, wherein the detents are positioned on the arm portions such that a first one of the detents facilitates maintaining the disconnection mechanism in a first position where the electrical circuit component is connected with the corresponding receptacle and a second one of the detents facilitates maintaining the disconnection mechanism in a second position where the electrical circuit component is disconnected from the corresponding receptacle.

8. In a disconnection mechanism as defined in claim 1, wherein the turrets each include a balcony wherein each balcony surrounds at least two sides of a respective one of the depressible portion of the arm portions.

9. In a disconnection mechanism as defined in claim 8, wherein the depressible portion of the arm portion includes ridges, the ridges being formed on the depressible portion of the arm portion that is not surrounded by a respective balcony.

* * * * *